US005803310A

United States Patent [19]

Soon

[11] Patent Number: 5,803,310

[45] Date of Patent: Sep. 8, 1998

[54] BOTTLE CAP ADAPTABLE SPOUT

[76] Inventor: Min Tet Soon, P.O. Box 10341, 88803 Kota Kinabalu, Malaysia

[21] Appl. No.: 759,163

[22] Filed: Dec. 3, 1996

[51] Int. Cl.[6] ..... B67B 7/00

[52] U.S. Cl. ..... 222/1; 222/81; 222/212; 222/420

[58] Field of Search ..... 222/1, 80, 81, 222/212, 420, 211, 527, 568

[56] References Cited

U.S. PATENT DOCUMENTS

| | | | |
|---|---|---|---|
| 3,572,558 | 3/1971 | Hooker | 222/420 |
| 4,014,468 | 3/1977 | Silverman et al. | 239/327 |
| 4,925,128 | 5/1990 | Brody | 222/516 |
| 5,169,035 | 12/1992 | Imbery, Jr. | 222/212 |
| 5,249,714 | 10/1993 | Merhar | 222/500 |

*Primary Examiner*—Gregory L. Huson
*Attorney, Agent, or Firm*—Richard L. Miller, P.E.

[57] ABSTRACT

A bottle cap adaptable spout that is attachable to an appropriately modified plastic cap of a spent motor oil bottle that converts the spent motor oil bottle into an oiler for dispensing oil contained therein. The spout includes a hollow, elongated, slender, and cylindrically-shaped spout tube, a hollow and generally conically-shaped nozzle that extends from one end of the hollow, elongated, slender, and cylindrically-shaped spout tube, a hollow, externally-threaded, and cylindrically-shaped tube that extends from another end of the hollow, elongated, slender, and cylindrically-shaped spout tube, a first combination hexagonally-shaped nut and washer that threadably engages the hollow, externally-threaded, and cylindrically-shaped tube externally to the plastic cap of the spent motor oil bottle, a second combination hexagonally-shaped nut and washer that threadably engages the hollow, externally-threaded, and cylindrically-shaped tube internally to the plastic cap of the spent motor oil bottle, and a hollow, elongated, slender, and cylindrically-shaped pick-up tube that extends from one end of the hollow, externally-threaded, and cylindrically-shaped tube and into the spent motor oil bottle, so that when the spent motor oil bottle is squeezed the oil contained therein is picked up by the hollow, elongated, slender, and cylindrically-shaped pick-up tube and flows therethrough, through the hollow, externally-threaded, and cylindrically-shaped tube, through the hollow, elongated, slender, and cylindrically-shaped spout tube, and through and out of the hollow and generally conically-shaped nozzle allowing the spent motor oil bottle to function as the oiler and selectively dispense the oil contained therein.

18 Claims, 2 Drawing Sheets

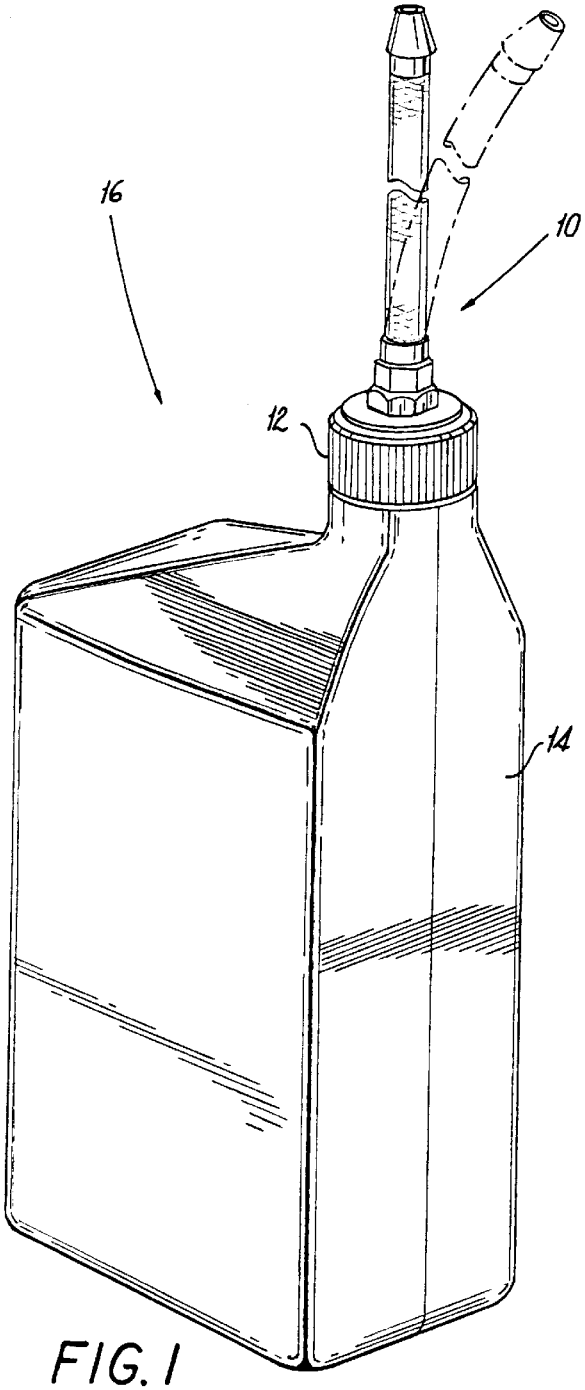
FIG. 1
FIG. 2
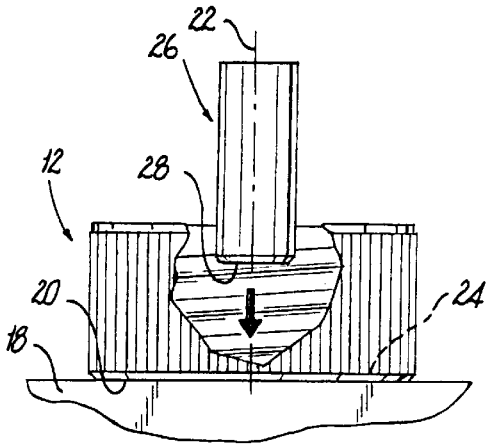
FIG. 3
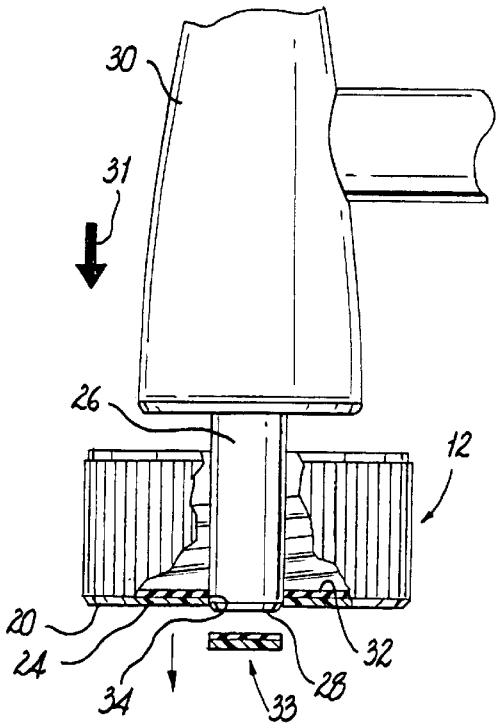

BOTTLE CAP ADAPTABLE SPOUT

BACKGROUND OF THE INVENTION

The present invention relates to a bottle cap adaptable spout. More particularly, the present invention relates to a bottle cap adaptable spout that is attachable to an appropriately modified plastic cap of a spent motor oil bottle that converts the spent motor oil bottle into an oiler for dispensing oil contained therein wherein the spout includes a hollow, elongated, slender, and cylindrically-shaped spout tube, a hollow and generally conically-shaped nozzle that extends from one end of the hollow, elongated, slender, and cylindrically-shaped spout tube, a hollow, externally-threaded, and cylindrically-shaped tube that extends from another end of the hollow, elongated, slender, and cylindrically-shaped spout tube, a first combination hexagonally-shaped nut and washer that threadably engages the hollow, externally-threaded, and cylindrically-shaped tube externally to the plastic cap of the spent motor oil bottle, a second combination hexagonally-shaped nut and washer that threadably engages the hollow, externally-threaded, and cylindrically-shaped tube internally to the plastic cap of the spent motor oil bottle, and a hollow, elongated, slender, and cylindrically-shaped pick-up tube that extends from one end of the hollow, externally-threaded, and cylindrically-shaped tube and into the spent motor oil bottle, so that when the spent motor oil bottle is squeezed the oil contained therein is picked up by the hollow, elongated, slender, and cylindrically-shaped pick-up tube and flows therethrough, through the hollow, externally-threaded, and cylindrically-shaped tube, through the hollow, elongated, slender, and cylindrically-shaped spout tube, and through and out of the hollow and generally conically-shaped nozzle allowing the spent motor oil bottle to function as the oiler and selectively dispense the oil contained therein.

When one pours oil into a filler opening, one often needs to use a funnel or a spout to avoid spillage. A funnel may not be satisfactory for hard to reach areas and it is messy and drips. A spout extends the oil container opening and makes filler openings that are difficult to access more accessible.

Millions of plastic oil bottles and the like are thrown away daily causing environmental pollution and waste of recyclable plastic. If the caps of these bottles can be adapted with a spout, they can be used as inexpensive supplemental oilers, especially since these bottles are available free of charge at workshops, service stations, gas stations, etc.

Numerous innovations for spouts have been provided in the prior art that will be described. Even though these innovations may be suitable for the specific individual purposes to which they address, however, they differ from the present invention in that they do not teach a bottle cap adaptable spout that is attachable to an appropriately modified plastic cap of a spent motor oil bottle that converts the spent motor oil bottle into an oiler for dispensing oil contained therein wherein the spout includes a hollow, elongated, slender, and cylindrically-shaped spout tube, a hollow and generally conically-shaped nozzle that extends from one end of the hollow, elongated, slender, and cylindrically-shaped spout tube, a hollow, externally-threaded, and cylindrically-shaped tube that extends from another end of the hollow, elongated, slender, and cylindrically-shaped spout tube, a first combination hexagonally-shaped nut and washer that threadably engages the hollow, externally-threaded, and cylindrically-shaped tube externally to the plastic cap of the spent motor oil bottle, a second combination hexagonally-shaped nut and washer that threadably engages the hollow, externally-threaded, and cylindrically-shaped tube internally to the plastic cap of the spent motor oil bottle, and a hollow, elongated, slender, and cylindrically-shaped pick-up tube that extends from one end of the hollow, externally-threaded, and cylindrically-shaped tube and into the spent motor oil bottle, so that when the spent motor oil bottle is squeezed the oil contained therein is picked up by the hollow, elongated, slender, and cylindrically-shaped pick-up tube and flows therethrough, through the hollow, externally-threaded, and cylindrically-shaped tube, through the hollow, elongated, slender, and cylindrically-shaped spout tube, and through and out of the hollow and generally conically-shaped nozzle allowing the spent motor oil bottle to function as the oiler and selectively dispense the oil contained therein.

FOR EXAMPLE, U.S. Pat. No. 4,014,468 to Silverman et al. teaches a squeeze bottle dispenser that includes a resilient squeeze bottle and a plug insert in the neck of the bottle. The plug insert receives a dip tube assembly the includes a dip tube and a short tube element adjacent the discharge orifice of the plug insert. The short tube element defines a passageway having a diameter of from about 0.014 to about 0.040 inch and is from about one-sixteenth to about 1 inch in length. The dip tube internal diameter is substantially greater than the diameter of the short tube element passageway. The short tube element may be inserted in the upper end of the dip tube or may abut the upper end of the dip tube. The making of the dip tube assembly includes the steps of providing a short tube element and a long dip tube, and inserting the short element into the dip tube, with the upper ends of the element and tube being flush.

ANOTHER EXAMPLE, U.S. Pat. No. 4,925,128 to Brody teaches an improved spout assembly for a squeeze bottle or the like that includes an extensible dispensing tube slidably disposed in an elongated, hollow cap member, with the distal end of the tube extending from an orifice at the tip of the cap member. The tube is extensible from the cap member to a selected extended position. The cap member includes a plurality of discrete, spaced-apart, rib like bearing elements extending radially inwardly from the interior wall surface of the cap near the tip. The bearing elements frictionally engage the extensible tube so as to maintain the tube in a selected position. The cap member is made of injection-molded plastic formed in a mold assembly that includes a solid core and a hollow cavity. The core has a cylindrical plug extending axially from its tip. The plug snugly seats in a socket at the bottom of the cavity. When molten plastic is injected into the gap between the core and the walls of the cavity, the cap is formed with an orifice created around the juncture between the plug and the socket.

STILL ANOTHER EXAMPLE, U.S. Pat. No. , 5,169,035 to Imbery, Jr. teaches a closure for use in a squeeze-type container that defines a discharge communicating with the container interior in which the fluid product is contained. The closure includes a body that is mounted to the container over the container opening. An insert member is mounted in the body. In one embodiment, the insert member defines a dispensing orifice through which the container contents can be dispensed, and the closure body defines a vent aperture adjacent the insert member for cooperating with the insert member to define a vent passage between the container opening and the ambient atmosphere. A resilient sealing lip is defined by the insert member for sealingly engaging the interior surface of the closure body around the vent aperture in a closed position. The sealing lip is shifted out of sealing engagement to an open position when the ambient atmospheric pressure exceeds the pressure within the container, and this permits equalization of the container pressure and the ambient atmospheric pressure. A lid is provided that is moved to a closed position on the closure body, and the lid has a plug member that is sealingly received in the dispensing orifice of the insert member to occlude the dispensing orifice. In another embodiment, the dispensing orifice and vent aperture are separately defined within, and by, the closure body.

FINALLY, YET ANOTHER EXAMPLE, U.S. Pat. No. 5,249,714 to Merhar teaches a spout that fits all quart containers and is characterized by a twist of the wrist to start and stop oil flow. The spout consists of a tubular cylinder into which an angled ball valve seat and a bubble run-off area has been incorporated. A steel ball moving on and off its valve seat due to the angle of the valve seat and gravity stops and starts the oil-flow. When the bubble run-off area is pointed down, causing the steel ball to lodge itself in the bubble run-off area, the oil flows and with a twist of the wrist, making a 180 degree rotation of the spout, the bubble run-off area points up causing the steel ball to seat itself on the valve seat and the oil flow stops. Two tip sizes are incorporated in the spout for small and large filler openings. The small tip is for lawn mower and motorcycles for example and the larger for cars for example. The larger opening is obtained by cutting with a knife or razor or other cutting instrument the spout in a molded recessed area inward of the smaller tip.

It is apparent that numerous innovations for spouts have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a bottle cap adaptable spout that avoids the disadvantages of the prior art.

ANOTHER OBJECT of the present invention is to provide a bottle cap adaptable spout that is simple and inexpensive to manufacture.

STILL ANOTHER OBJECT of the present invention is to provide a bottle cap adaptable spout that is simple to use.

YET ANOTHER OBJECT of the present invention is to provide a bottle cap adaptable spout that utilizes plastic oil bottles that are thrown away daily world wide.

STILL YET ANOTHER OBJECT of the present invention is to provide a bottle cap adaptable spout that reduces environmental pollution and waste caused by discarded plastic oil bottles.

YET STILL ANOTHER OBJECT of the present invention is to provide a bottle cap adaptable spout that recycles plastic oil bottles.

STILL YET ANOTHER OBJECT of the present invention is to provide a bottle cap adaptable spout that is attachable to an appropriately modified cap of an oil bottle and converts the oil bottle into an oiler.

YET STILL ANOTHER OBJECT of the present invention is to provide a bottle cap adaptable spout that uses, for example 1 and 1.5 liter plastic motor oil bottles.

STILL YET ANOTHER OBJECT of the present invention is to provide a bottle cap adaptable spout that uses plastic motor oil bottles available free of charge from workshops, service stations, gas stations, etc.

YET STILL ANOTHER OBJECT of the present invention is to provide a bottle cap adaptable spout allows oilers to made by individuals without having to purchase them.

STILL YET ANOTHER OBJECT of the present invention is to provide a bottle cap adaptable spout that provides a better solution for the disposal of oil bottles.

YET STILL ANOTHER OBJECT of the present invention is to provide a bottle cap adaptable spout that is attachable to a plastic cap of a spent motor oil bottle that has been appropriately modified by having a centrally-disposed and circular-shaped throughbore with a diameter punched into a closed and circular-shaped top of the plastic cap of the spent motor oil bottle so as to convert the spent motor oil bottle into an oiler for dispensing oil contained therein wherein the closed and circular-shaped top of the plastic cap of the spent motor oil bottle has an outer surface and an inner surface with a gasket thereon.

BRIEFLY STATED, STILL YET ANOTHER OBJECT of the present invention is to provide a bottle cap adaptable spout that includes a hollow, elongated, slender, and cylindrically-shaped spout tube, a hollow and generally conically-shaped nozzle, a hollow, externally-threaded, and cylindrically-shaped tube, a hexagonally-shaped nut, a hollow and cylindrically-shaped collar, a first combination hexagonally-shaped nut and washer, a first circular-shaped washer, a second circular-shaped washer, a second combination hexagonally-shaped nut and washer, and a hollow, elongated, slender, and cylindrically-shaped pick-up tube.

YET STILL ANOTHER OBJECT of the present invention is to provide a bottle cap adaptable spout wherein the hollow, elongated, slender, and cylindrically-shaped spout tube has an open proximal end and an open distal end.

STILL YET ANOTHER OBJECT of the present invention is to provide a bottle cap adaptable spout wherein the hollow and generally conically-shaped nozzle extends coaxially outwardly from, and is in fluid communication with, the open distal end of the hollow, elongated, slender, and cylindrically-shaped spout tube.

YET STILL ANOTHER OBJECT of the present invention is to provide a bottle cap adaptable spout wherein the hollow, externally-threaded, and cylindrically-shaped tube has an open distal end, an open proximal end that enters the centrally-disposed and circular-shaped throughbore in the closed and circular-shaped top of the plastic cap of the spent motor oil bottle and into the spent motor oil bottle, and a diameter.

STILL YET ANOTHER OBJECT of the present invention is to provide a bottle cap adaptable spout wherein the hexagonally-shaped nut is fixedly and coaxially attached to, and in fluid communication with, the open distal end of the hollow, externally-threaded, and cylindrically-shaped tube and provides a holding surface for at least one of turning the hollow, externally-threaded, and cylindrically-shaped tube and turning components relative thereto.

YET STILL ANOTHER OBJECT of the present invention is to provide a bottle cap adaptable spout wherein the hollow and cylindrically-shaped collar extends coaxially outwardly from, and is in fluid communication with, the hexagonally-shaped nut, and coaxially and fixedly receives the open proximal end of the hollow, elongated, slender, and cylindrically-shaped spout tube and is in fluid communication therewith.

STILL YET ANOTHER OBJECT of the present invention is to provide a bottle cap adaptable spout wherein the first combination hexagonally-shaped nut and washer has a hexagonally-shaped nut and a circular-shaped washer that is integrally formed with, and in fluid communication with, the hexagonally-shaped nut of the first combination hexagonally-shaped nut and washer.

YET STILL ANOTHER OBJECT of the present invention is to provide a bottle cap adaptable spout wherein the hexagonally-shaped nut of the first combination hexagonally-shaped nut and washer threadably engages the hollow, externally-threaded, and cylindrically-shaped tube, with the circular-shaped washer of the first combination hexagonally-shaped nut and washer facing downwardly towards the open proximal end of the hollow, externally-threaded, and cylindrically-shaped tube.

STILL YET ANOTHER OBJECT of the present invention is to provide a bottle cap adaptable spout wherein the first circular-shaped washer is disposed on the hollow, externally-threaded, and cylindrically-shaped tube, between, and abutting against, the circular-shaped washer of the first combination hexagonally-shaped nut and washer and the outer surface of the closed and circular-shaped top of the plastic cap of the spent motor oil bottle.

YET STILL ANOTHER OBJECT of the present invention is to provide a bottle cap adaptable spout wherein the second circular-shaped washer is disposed on the hollow, externally-threaded, and cylindrically-shaped tube, abutting against the gasket on the inner surface of the closed and circular-shaped top of the plastic cap of the spent motor oil bottle.

STILL YET ANOTHER OBJECT of the present invention is to provide a bottle cap adaptable spout wherein the second combination hexagonally-shaped nut and washer has a hexagonally-shaped nut and a circular-shaped washer that is integrally formed with, and in fluid communication with, the hexagonally-shaped nut of the second combination hexagonally-shaped nut and washer.

YET STILL ANOTHER OBJECT of the present invention is to provide a bottle cap adaptable spout wherein the hexagonally-shaped nut of the second combination hexagonally-shaped nut and washer threadably engages the hollow, externally-threaded, and cylindrically-shaped tube, with the circular-shaped washer of the second combination hexagonally-shaped nut and washer abutting against the second circular-shaped washer, so that when the first combination hexagonally-shaped nut and the second combination hexagonally-shaped nut are tightened the first circular-shaped washer snugly abuts against the outer surface of the closed and circular-shaped top of the plastic cap of the spent motor oil bottle and the second circular-shaped washer snugly abuts against the gasket on the inner surface of the closed and circular-shaped top of the plastic cap of the spent motor oil bottle causing the closed and circular-shaped top of the plastic cap of the spent motor oil bottle to longitudinally compress and laterally expand against the hollow, externally-threaded, and cylindrically-shaped tube and form a leak proof seal for the centrally-disposed and circular-shaped throughbore in the closed and circular-shaped top of the plastic cap of the spent motor oil bottle.

STILL YET ANOTHER OBJECT of the present invention is to provide a bottle cap adaptable spout wherein the hollow, elongated, slender, and cylindrically-shaped pick-up tube has an open distal end that is received coaxially in, and in fluid communication with, the open proximal end of the hollow, externally-threaded, and cylindrically-shaped tube, and an open proximal end that extends into the spent motor oil bottle and is in fluid communication with oil contained therein, so that when the spent motor oil bottle is squeezed the oil contained therein is picked up by the open proximal end of the hollow, elongated, slender, and cylindrically-shaped pick-up tube and flows through the hollow, elongated, slender, and cylindrically-shaped pick-up tube, through the hollow, externally-threaded, and cylindrically-shaped tube, through the hollow and cylindrically-shaped collar, through the hollow, elongated, slender, and cylindrically-shaped spout tube, and through and out of the hollow and generally conically-shaped nozzle allowing the spent motor oil bottle to function as the oiler and selectively dispense the oil contained therein.

YET STILL ANOTHER OBJECT of the present invention is to provide a bottle cap adaptable spout wherein the hollow, elongated, slender, and cylindrically-shaped spout tube is one of flexible and rigid.

STILL YET ANOTHER OBJECT of the present invention is to provide a bottle cap adaptable spout wherein the diameter of the hollow, externally-threaded, and cylindrically-shaped tube is equivalent to the diameter of the centrally-disposed and circular-shaped throughbore in the closed and circular-shaped top of the plastic cap of the spent motor oil bottle.

YET STILL ANOTHER OBJECT of the present invention is to provide a bottle cap adaptable spout wherein the hollow and cylindrically-shaped collar is crimped around the open proximal end of the hollow, elongated, slender, and cylindrically-shaped spout tube.

STILL YET ANOTHER OBJECT of the present invention is to provide a bottle cap adaptable spout wherein the hollow, elongated, slender, and cylindrically-shaped pick-up tube is plastic.

YET STILL ANOTHER OBJECT of the present invention is to provide a bottle cap adaptable spout wherein the open distal end of the hollow, elongated, slender, and cylindrically-shaped pick-up tube is maintained in the open proximal end of the hollow, externally-threaded, and cylindrically-shaped tube by a force fit.

STILL YET ANOTHER OBJECT of the present invention is to provide a bottle cap adaptable spout wherein the open proximal end of the hollow, elongated, slender, and cylindrically-shaped pick-up tube is slanted.

YET STILL ANOTHER OBJECT of the present invention is to provide a bottle cap adaptable spout wherein the hollow, elongated, slender, and cylindrically-shaped pick-up tube has a variable depth in the spent motor oil bottle and a length.

STILL YET ANOTHER OBJECT of the present invention is to provide a bottle cap adaptable spout wherein the variable depth of the hollow, elongated, slender, and cylindrically-shaped pick-up tube in the spent motor oil bottle is accomplished by trimming the length of the hollow, elongated, slender, and cylindrically-shaped pick-up tube.

YET STILL ANOTHER OBJECT of the present invention is to provide a bottle cap adaptable spout wherein the variable depth of the hollow, elongated, slender, and cylindrically-shaped pick-up tube in the spent motor oil bottle is accomplished by threading the hollow, externally-threaded, and cylindrically-shaped tube relative to at least one of the first combination hexagonally-shaped nut and washer and the second combination hexagonally-shaped nut and washer, so that a different amount of the hollow, externally-threaded, and cylindrically-shaped tube is in the spent motor oil bottle.

STILL YET ANOTHER OBJECT of the present invention is to provide a bottle cap adaptable spout that further includes punching apparatus that punches the centrally-disposed and circular-shaped throughbore in the closed and circular-shaped top of the plastic cap of the spent motor oil bottle and in the gasket on the inner surface of the closed and circular-shaped top of the plastic cap of the spent motor oil bottle.

YET STILL ANOTHER OBJECT of the present invention is to provide a bottle cap adaptable spout wherein the punching apparatus includes a hollow and cylindrically-shaped punch with a sharp end.

STILL YET ANOTHER OBJECT of the present invention is to provide a method of utilizing a bottle cap adaptable spout to convert a spent motor oil bottle into an oiler by attaching the bottle cap adaptable spout to a plastic cap of the spent motor oil bottle that has been appropriately modified that includes the steps of placing the plastic cap of the spent motor oil bottle on a hard work surface with a closed and circular-shaped top of the plastic cap of the spent motor oil bottle resting thereon; placing a hollow and cylindrically-shaped punching tool in the plastic cap of the spent motor oil bottle with a sharp punching end of the hollow and cylindrically-shaped punching tool resting on a gasket on an inner surface of the closed and circular-shaped top of the plastic cap of the spent motor oil bottle, at and coaxial with, a longitudinal center of the plastic cap of the spent motor oil bottle; hitting the cylindrically-shaped punching tool with a hammer forcing the sharp punching end of the cylindrically-shaped punching tool to pierce through the gasket on the inner surface of the closed and circular-shaped top of the plastic cap of the spent motor oil bottle and to pierce through the closed and circular-shaped top of the plastic cap of the spent motor oil bottle so as to punch out a plug and leave a centrally-disposed and circular-shaped throughbore extending therethrough that has a diameter; threading a hexagonally-shaped nut of a first combination hexagonally-shaped nut and washer of the bottle cap adaptable spout onto a hollow, externally-threaded, and cylindrically-shaped tube of the bottle cap adaptable spout, with a circular-shaped washer of the first combination hexagonally-shaped nut and washer facing downwardly towards an open proximal end of the hollow, externally-threaded, and cylindrically-shaped tube; placing a first circular-shaped washer of the bottle cap adaptable spout on the hollow, externally-threaded, and cylindrically-shaped tube, abutting against the circular-shaped washer of the first combination hexagonally-shaped nut and washer; inserting the open proximal end of the hollow, externally-threaded, and cylindrically-shaped tube through the centrally-disposed and circular-shaped throughbore in the closed and circular-shaped top of the plastic cap of the spent motor oil bottle, towards the gasket on the inner surface of the closed and circular-shaped top of the plastic cap of the spent motor oil bottle, so that the first circular-shaped washer is between, and abuts against, the circular-shaped washer of the first combination hexagonally-shaped nut and washer and an outer surface of the closed and circular-shaped top of the plastic cap of the spent motor oil bottle; placing a second circular-shaped washer of the bottle cap adaptable spout on the hollow, externally-threaded, and cylindrically-shaped tube, abutting against the gasket on the inner surface of the closed and circular-shaped top of the plastic cap of the spent motor oil bottle; threading a hexagonally-shaped nut of a second combination hexagonally-shaped nut and washer of the bottle cap adaptable spout onto the hollow, externally-threaded, and cylindrically-shaped tube, with a circular-shaped washer of the second combination hexagonally-shaped nut and washer abutting against the second circular-shaped washer, so that the second circular-shaped washer is between, and abuts against, the gasket on the inner surface of the closed and circular-shaped top of the plastic cap of the spent motor oil bottle and the circular-shaped washer of the second combination hexagonally-shaped nut and washer; tightening the hexagonally-shaped nut of the first combination hexagonally-shaped nut and washer and the hexagonally-shaped nut of the second combination hexagonally-shaped nut and washer so as to cause the first circular-shaped washer and the second circular-shaped washer to longitudinally compress and laterally expand the closed and circular-shaped top of the plastic cap of the spent motor oil bottle against the hollow, externally-threaded, and cylindrically-shaped tube so as to form a leak proof seal for the centrally-disposed and circular-shaped throughbore in the closed and circular-shaped top of the plastic cap of the spent motor oil bottle; inserting an open distal end of a hollow, elongated, slender, and cylindrically-shaped pick-up tube of the bottle cap adaptable spout snugly into the open proximal end of the hollow, externally-threaded, and cylindrically-shaped tube; inserting an open proximal end of the hollow, elongated, slender, and cylindrically-shaped pick-up tube through an externally-threaded neck of the spent motor oil bottle and into the spent motor oil bottle; and, threading the plastic cap of the spent motor oil bottle onto the externally-threaded neck of the spent motor oil bottle.

YET STILL ANOTHER OBJECT of the present invention is to provide a method of utilizing a bottle cap adaptable spout to convert a spent motor oil bottle into an oiler that further includes the step of determining if the hollow, elongated, slender, and cylindrically-shaped pick-up tube is of proper depth in the spent motor oil bottle.

STILL YET ANOTHER OBJECT of the present invention is to provide a method of utilizing a bottle cap adaptable spout to convert a spent motor oil bottle into an oiler that further the step of removing the plastic cap of the spent motor oil bottle from the externally-threaded neck of the spent motor oil bottle if the hollow, elongated, slender, and cylindrically-shaped pick-up tube is not of the proper depth in the spent motor oil bottle.

YET STILL ANOTHER OBJECT of the present invention is to provide a method of utilizing a bottle cap adaptable spout to convert a spent motor oil bottle into an oiler that further includes the step of trimming the hollow, elongated, slender, and cylindrically-shaped pick-up tube to a proper length.

FINALLY, STILL YET ANOTHER OBJECT of the present invention is to provide a method of utilizing a bottle cap adaptable spout to convert a spent motor oil bottle into an oiler that further includes the steps of loosening the hexagonally-shaped nut of the first combination hexagonally-shaped nut and washer and the hexagonally-shaped nut of the second combination hexagonally-shaped nut and washer; threading the hollow, externally-threaded, and cylindrically-shaped tube, by use of a hexagonally-shaped nut fixedly attached thereto, relative to at least one of the hexagonally-shaped nut of the first combination hexagonally-shaped nut and washer and the hexagonally-shaped nut of the second combination hexagonally-shaped nut and washer until a desired position of the hollow, externally-threaded, and cylindrically-shaped tube relative to the plastic cap of the spent motor oil bottle is achieved, so that a different amount of the hollow, externally-threaded, and cylindrically-shaped tube is in the spent motor oil bottle when the plastic cap of the spent motor oil bottle is replaced; tightening the hexagonally-shaped nut of the first combination hexagonally-shaped nut and washer and the hexagonally-shaped nut of the second combination hexagonally-shaped nut and washer; inserting again the open proximal end of the hollow, elongated, slender, and cylindrically-shaped pick-up tube through the externally-threaded neck of the spent motor oil bottle and into the spent motor oil bottle; and, threading again the oil bottle plastic cap of the spent motor oil bottle onto the externally-threaded neck of the spent motor oil bottle.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention attached to an appropriately modified cap of an oil bottle and converting the oil bottle into an oiler;

FIG. 2 is an enlarged diagrammatic side elevational view of the cap of the oil bottle with parts broken away prior to modification thereof;

FIG. 3 is an enlarged diagrammatic side elevational view of the cap of the oil bottle with parts broken away subsequent to modification thereof;

LIST OF REFERENCE NUMERALS UTILIZED IN THE DRAWING

Figure 4:
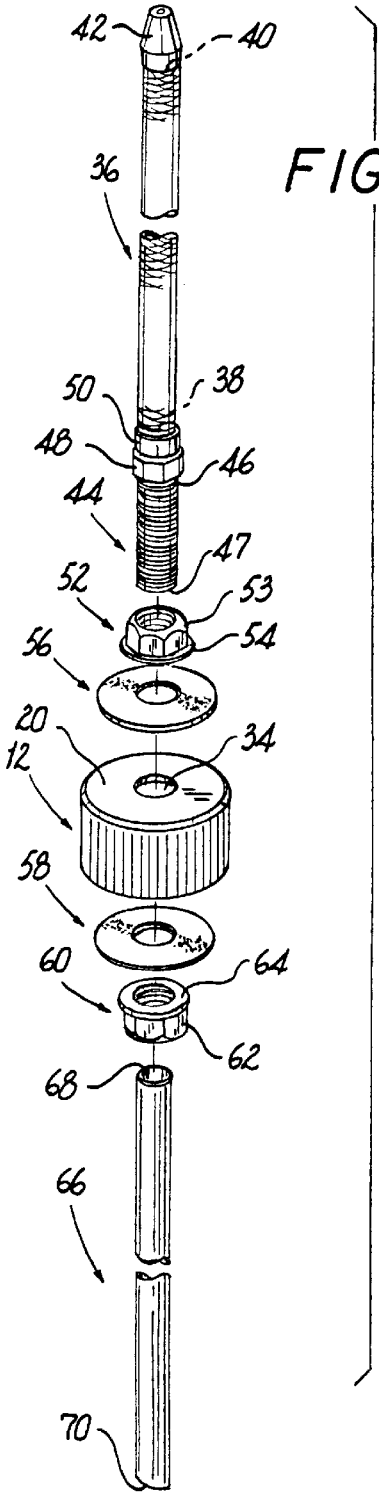
FIG. 4 is an exploded diagrammatic perspective view of the present invention.

10 bottle cap adaptable spout of the present invention
12 oil bottle plastic cap
14 spent motor oil bottle
16 oiler
18 hard work surface
20 oil bottle cap closed and circular-shaped top
22 oil bottle cap longitudinal center
24 oil bottle cap top inner surface
26 hollow and cylindrically-shaped punching tool
28 punching tool sharp punching end
30 hammer
31 hammer hit arrow
32 oil bottle cap top inner surface gasket
33 oil bottle cap plug
34 oil bottle cap top centrally-disposed and circular-shaped throughbore
36 hollow, elongated, slender, and cylindrically-shaped spout tube
38 spout tube open proximal end
40 spout tube open distal end
42 hollow and generally conically-shaped nozzle
44 hollow, externally-threaded, and cylindrically-shaped tube
46 tube open distal end
47 tube open proximal end
48 hexagonally-shaped nut
50 hollow and cylindrically-shaped collar
52 first combination hexagonally-shaped nut and washer
53 first combination nut and washer hexagonally-shaped nut
54 first combination nut and washer circular-shaped washer
56 first circular-shaped washer
58 second circular-shaped washer
60 second combination hexagonally-shaped nut and washer
62 second combination nut and washer hexagonally-shaped nut
64 second combination nut and washer circular-shaped washer
66 hollow, elongated, slender, and cylindrically-shaped pick-up tube
68 pick-up tube open distal end
70 pick-up tube open proximal end
72 oil bottle externally-threaded neck

DETAILED DESCRIPTION OF THE PREFERRED EMBODIMENT

Referring now to the figures in which like numerals indicate like parts, and particularly to FIG. 1, which is a diagrammatic perspective view of the present invention attached to an appropriately modified cap of an oil bottle and converting the oil bottle into an oiler, the bottle cap adaptable spout of the present invention is shown generally at 10 attached to an oil bottle plastic cap 12 of a spent motor oil bottle 14 that is appropriately modified and converting the spent motor oil bottle 14 into an oiler 16. The spent motor oil bottle 14 is preferably 1 or 1.5 liter.

The method of appropriately modifying the oil bottle plastic cap 12 of the spent motor oil bottle 14 can best be seen in FIGS. 2 and 3, which are an enlarged diagrammatic side elevational view of the cap of the oil bottle with parts broken away prior to modification thereof, and an enlarged diagrammatic side elevational view of the cap of the oil bottle with parts broken away subsequent to modification thereof, respectively, and as such will be discussed with reference thereto.

STEP 1: As shown in FIG. 2, place the oil bottle plastic cap 12, that has an oil bottle cap longitudinal center 22, of the spent motor oil bottle 14 on a hard work surface 18, with an oil bottle cap closed and circular-shaped top 20 of the oil bottle plastic cap 12 of the spent motor oil bottle 14 resting thereon and having an oil bottle cap top inner surface 24.

STEP 2: Place a hollow and cylindrically-shaped punching tool 26, which is preferably sheet steel and for single use only, in the oil bottle plastic cap 12 of the spent motor oil bottle 14 with a punching tool sharp punching end 28 of the hollow and cylindrically-shaped punching tool 26 resting on the oil bottle cap top inner surface 24 of the oil bottle cap closed and circular-shaped top 20 of the oil bottle plastic cap 12 of the spent motor oil bottle 14, at and coaxial with, the oil bottle cap longitudinal center 22 of the oil bottle plastic cap 12 of the spent motor oil bottle 14.

STEP 3: As shown in FIG. 3, hit the cylindrically-shaped punching tool 26 with a hammer 30, in the direction of an hammer hit arrow 31, forcing the punching tool sharp punching end 28 of the cylindrically-shaped punching tool 26 to pierce through an oil bottle cap top inner surface gasket 32 on the oil bottle cap closed top inner surface 24 of the oil bottle cap closed and circular-shaped top 20 of the oil bottle plastic cap 12 of the spent motor oil bottle 14 and to pierce through the oil bottle cap closed and circular-shaped top 20 of the oil bottle plastic cap 12 of the spent motor oil bottle 14 so as to punch out an oil bottle cap plug 33 and leave an oil bottle cap top centrally-disposed and circular-shaped throughbore 34 extending therethrough with a diameter.

Figure 5:
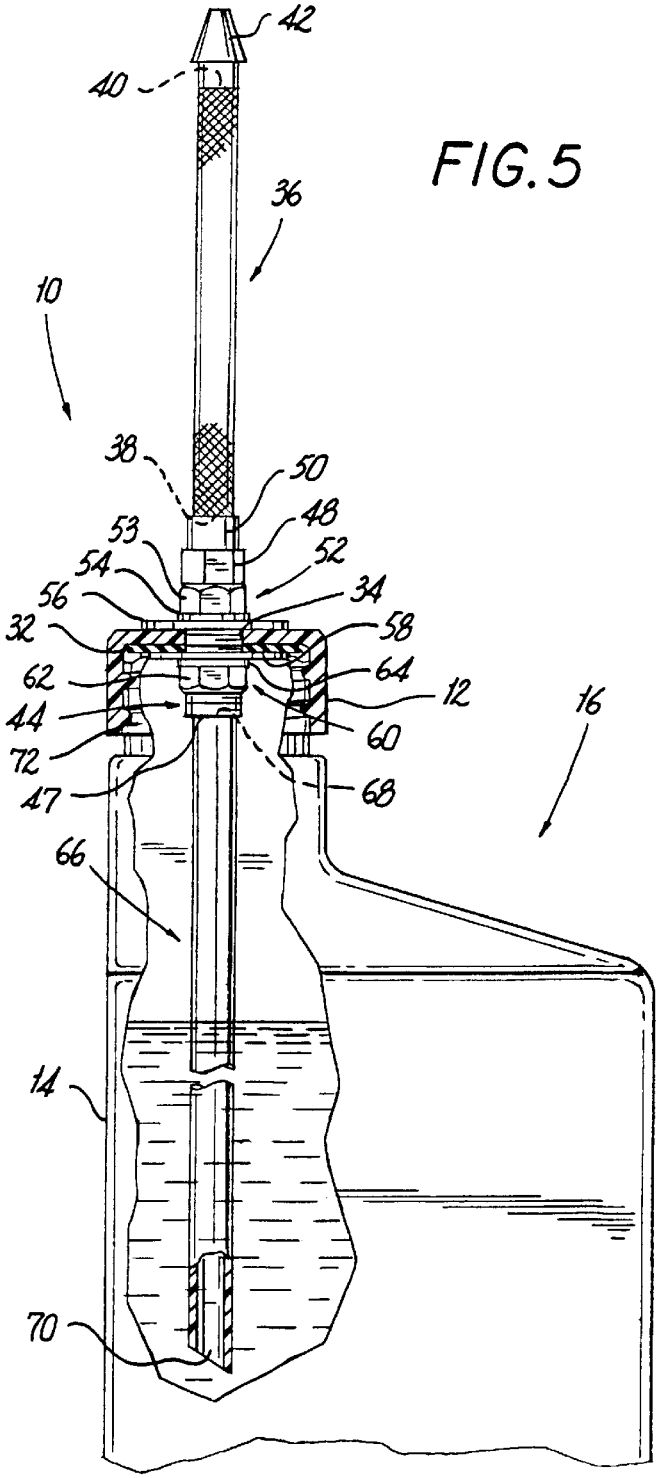
FIG. 5 is a diagrammatic side elevational view with parts cut away and in partial section of the present invention attached to the appropriately modified cap of the oil bottle and converting the oil bottle into the oiler.

The configuration of the bottle cap adaptable spout 10 and its interface with the oil bottle plastic cap 12 of the spent motor oil bottle 14 and the spent motor oil bottle 14 can best be seen in FIGS. 4 and 5, which are an exploded diagrammatic perspective view of the present invention, and a diagrammatic side elevational view with parts cut away and in partial section of the present invention attached to the appropriately modified cap of the oil bottle and converting the oil bottle into the oiler, respectively, and as such will be discussed with reference thereto.

The bottle cap adaptable spout 10 includes a hollow, elongated, slender, and cylindrically-shaped spout tube 36 that is preferably rigid or hard, and has a spout tube open proximal end 38 and a spout tube open distal end 40.

The bottle cap adaptable spout 10 further includes a hollow and generally conically-shaped nozzle 42 that extends coaxially outwardly from, and is in fluid communication with, the spout tube open distal end 40 of the hollow, elongated, slender, and cylindrically-shaped spout tube 36.

The bottle cap adaptable spout 10 further includes a hollow, externally-threaded, and cylindrically-shaped tube 44 that has a tube open distal end 46, a tube open proximal end 47 that enters the oil bottle cap top centrally-disposed and circular-shaped throughbore 34 in the oil bottle cap closed and circular-shaped top 20 of the oil bottle plastic cap 12 of the spent motor oil bottle 14 and into the spent motor oil bottle 14, and a diameter equivalent to the diameter of the oil bottle cap top centrally-disposed and circular-shaped throughbore 34 in the oil bottle cap closed and circular-shaped top 20 of the oil bottle plastic cap 12 of the spent motor oil bottle 14.

The bottle cap adaptable spout 10 further includes a hexagonally-shaped nut 48 that is fixedly attached coaxially to, and in fluid communication with, the tube open distal end 46 of the hollow, externally-threaded, and cylindrically-shaped tube 44, and provides a holding surface for turning the hollow, externally-threaded, and cylindrically-shaped tube 44 or when components are turned relative thereto.

The bottle cap adaptable spout 10 further includes a hollow and cylindrically-shaped collar 50 that extends coaxially outwardly from, and is in fluid communication with, the hexagonally-shaped nut 48 and coaxially and fixedly receives, by being crimped around, the spout tube open proximal end 38 of the hollow, elongated, slender, and cylindrically-shaped spout tube 36, while being in fluid communication therewith.

The bottle cap adaptable spout 10 further includes a first combination hexagonally-shaped nut and washer 52 that has a first combination nut and washer hexagonally-shaped nut 53 and a first combination nut and washer circular-shaped washer 54 that is integrally formed with, and is in fluid communication with, the first combination nut and washer hexagonally-shaped nut 53 of the first combination hexagonally-shaped nut and washer 52.

The first combination nut and washer hexagonally-shaped nut 53 of the first combination hexagonally-shaped nut and washer 52 threadably engages the hollow, externally-threaded, and cylindrically-shaped tube 44, with the first combination nut and washer circular-shaped washer 54 of the first combination hexagonally-shaped nut and washer 52 facing towards the tube open proximal end 47 of the hollow, externally-threaded, and cylindrically-shaped tube 44.

The bottle cap adaptable spout 10 further includes a first circular-shaped washer 56 disposed on the hollow, externally-threaded, and cylindrically-shaped tube 44, between, and abutting against, the first combination nut and washer circular-shaped washer 54 of the first combination hexagonally-shaped nut and washer 52 and the outer surface of the oil bottle cap closed and circular-shaped top 20 of the oil bottle plastic cap 12 of the spent motor oil bottle 14.

The bottle cap adaptable spout 10 further includes a second circular-shaped washer 58 disposed on the hollow, externally-threaded, and cylindrically-shaped tube 44, abutting against the oil bottle cap top inner surface gasket 32 on the oil bottle cap closed top inner surface 24 of the oil bottle cap closed and circular-shaped top 20 of the oil bottle plastic cap 12 of the spent motor oil bottle 14.

The bottle cap adaptable spout 10 further includes a second combination hexagonally-shaped nut and washer 60 that has a second combination nut and washer hexagonally-shaped nut 62 and a second combination nut and washer circular-shaped washer 64 that is integrally formed with, and is in fluid communication with, the second combination nut and washer hexagonally-shaped nut 62 of the second combination hexagonally-shaped nut and washer 60.

The second combination nut and washer hexagonally-shaped nut 62 of the second combination hexagonally-shaped nut and washer 60 threadably engages the hollow, externally-threaded, and cylindrically-shaped tube 44, with the second combination nut and washer circular-shaped washer 64 of the second combination hexagonally-shaped nut and washer 60 abutting against the second circular-shaped washer 58.

The bottle cap adaptable spout 10 further includes a hollow, elongated, slender, and cylindrically-shaped pick-up tube 66 that is preferably plastic, and has a pick-up tube open distal end 68 that is received coaxially in, and is in fluid communication with, the tube open proximal end 47 of the hollow, externally-threaded, and cylindrically-shaped tube 44, and is maintained therein by a force fit. The hollow, elongated, slender, and cylindrically-shaped pick-up tube 66 further has a pick-up tube open proximal end 70 that is preferably slanted.

It is to be understood that the hollow, elongated, slender, and cylindrically-shaped pick-up tube 66 can be eliminated if the oiler 16 is to be used solely in the inverted vertical position.

It is to be further understood that since the bottle cap adaptable spout 10 can be used with the oil bottle 16 of varying sizes, the depth that the hollow, elongated, slender, and cylindrically-shaped pick-up tube 66 enters the oil bottle 16 must be adjustable.

This can be accomplished in one of two ways. One way would be simply to trim the length of the hollow, elongated, slender, and cylindrically-shaped pick-up tube 66. This method is less than perfect, since it may limit the use of the bottle cap adaptable spout 10 on another oil bottle 16. A better way is to simply adjust the position of the hollow, externally-threaded, and cylindrically-shaped tube 44 relative to both the first combination hexagonally-shaped nut and washer 52 and the second combination hexagonally-shaped nut and washer 60.

The method of converting the spent motor oil bottle 14 into the oiler 16 can best be seen in FIG. 5, which again is a diagrammatic side elevational view with parts cut away and in partial section of the present invention attached to the appropriately modified cap of the oil bottle and converting the oil bottle into the oiler.

STEP 1: Appropriately modify the oil bottle plastic cap 12.

STEP 2: Thread the first combination nut and washer hexagonally-shaped nut 53 of the first combination hexagonally-shaped nut and washer 52 onto the hollow, externally-threaded, and cylindrically-shaped tube 44, with the first combination nut and washer circular-shaped washer 54 of the first combination hexagonally-shaped nut and washer 52 facing downwardly towards the tube open proximal end 47 of the hollow, externally-threaded, and cylindrically-shaped tube 44.

STEP 3: Place the first circular-shaped washer 56 on the hollow, externally-threaded, and cylindrically-shaped tube 44, abutting against the first combination nut and washer circular-shaped washer 54 of the first combination hexagonally-shaped nut and washer 52.

STEP 4: Insert the tube open proximal end 47 of the hollow, externally-threaded, and cylindrically-shaped tube 44 through the oil bottle cap top centrally-disposed and circular-shaped throughbore 34 in the oil bottle cap closed and circular-shaped top 20 of the oil bottle plastic cap 12 of the spent motor oil bottle 14, towards the oil bottle cap top inner surface gasket 32 on the oil bottle cap closed top inner surface 24 of the oil bottle cap closed and circular-shaped top 20 of the oil bottle plastic cap 12 of the spent motor oil bottle 14, so that the first circular-shaped washer 56 is between, and abuts against, the first combination nut and washer circular-shaped washer 54 of the first combination hexagonally-shaped nut and washer 52 and the outer surface of the oil bottle cap closed and circular-shaped top 20 of the oil bottle plastic cap 12 of the spent motor oil bottle 14.

STEP 5: Place the second circular-shaped washer 58 on the hollow, externally-threaded, and cylindrically-shaped tube 44, abutting against the oil bottle cap top inner surface gasket 32 on the oil bottle cap closed top inner surface 24 of the oil bottle cap closed and circular-shaped top 20 of the oil bottle plastic cap 12 of the spent motor oil bottle 14.

STEP 6: Thread the second combination nut and washer hexagonally-shaped nut 62 of the second combination hexagonally-shaped nut and washer 60 onto the hollow, externally-threaded, and cylindrically-shaped tube 44, with the second combination nut and washer circular-shaped washer 64 of the second combination hexagonally-shaped nut and washer 60 abutting against the second circular-shaped washer 58, so that the second circular-shaped washer 58 is between, and abuts against, the oil bottle cap top inner surface gasket 32 on the oil bottle cap closed top inner surface 24 of the oil bottle cap closed and circular-shaped top 20 of the oil bottle plastic cap 12 of the spent motor oil bottle 14 and the second combination nut and washer circular-shaped washer 64 of the second combination hexagonally-shaped nut and washer 60.

STEP 7: Tighten the first combination nut and washer hexagonally-shaped nut 53 of the first combination hexagonally-shaped nut and washer 52 and the second combination nut and washer hexagonally-shaped nut 62 of the second combination hexagonally-shaped nut and washer 60 so as to cause the first circular-shaped washer 56 and the second circular-shaped washer 58 to longitudinally compress and laterally expand the oil bottle cap closed and circular-shaped top 20 of the oil bottle plastic cap 12 of the spent motor oil bottle 14 against the hollow, externally-threaded, and cylindrically-shaped tube 44 and form a leak proof seal for the oil bottle cap top centrally-disposed and circular-shaped throughbore 34 in the oil bottle cap closed and circular-shaped top 20 of the oil bottle plastic cap 12 of the spent motor oil bottle 14.

STEP 8: Insert the pick-up tube open distal end 68 of the hollow, elongated, slender, and cylindrically-shaped pick-up tube 66 snugly into the tube open proximal end 47 of the hollow, externally-threaded, and cylindrically-shaped tube 44.

STEP 9: Insert the pick-up tube open proximal end 70 of the hollow, elongated, slender, and cylindrically-shaped pick-up tube 66 through an oil bottle externally-threaded neck 72 of the spent motor oil bottle 14 and into the spent motor oil bottle 14.

STEP 10: Thread the oil bottle plastic cap 12 of the spent motor oil bottle 14 onto the oil bottle externally-threaded neck 72 of the spent motor oil bottle 14.

STEP 11: Determine if the hollow, elongated, slender, and cylindrically-shaped pick-up tube 66 is of the proper depth, if not.

STEP 12: Remove the oil bottle plastic cap 12 of the spent motor oil bottle 14 from the oil bottle externally-threaded neck 72 of the spent motor oil bottle 14.

STEP 13: Loosen the first combination nut and washer hexagonally-shaped nut 53 of the first combination hexagonally-shaped nut and washer 52 and the second combination nut and washer hexagonally-shaped nut 62 of the second combination hexagonally-shaped nut and washer 60.

STEP 14: Thread the hollow, externally-threaded, and cylindrically-shaped tube 44, by use of the hexagonally-shaped nut 48, relative to at least one of the first combination nut and washer hexagonally-shaped nut 53 of the first combination hexagonally-shaped nut and washer 52 and the second combination nut and washer hexagonally-shaped nut 62 of the second combination hexagonally-shaped nut and washer 60 until the desired position of the hollow, externally-threaded, and cylindrically-shaped tube 44 relative to the oil bottle plastic cap 12 of the spent motor oil bottle 14 is achieved, so that a different amount of the hollow, externally-threaded, and cylindrically-shaped tube 44 is in the spent motor oil bottle 14 when the oil bottle plastic cap 12 of the spent motor oil bottle 14 is replaced.

STEP 15: Tighten the first combination nut and washer hexagonally-shaped nut 53 of the first combination hexagonally-shaped nut and washer 52 and the second combination nut and washer hexagonally-shaped nut 62 of the second combination hexagonally-shaped nut and washer 60, so that the first circular-shaped washer 56, the oil bottle plastic cap 12, and the second circular-shaped washer 58 are again secured therebetween.

STEP 16: Insert again the pick-up tube open proximal end 70 of the hollow, elongated, slender, and cylindrically-shaped pick-up tube 66 through the oil bottle externally-threaded neck 72 of the spent motor oil bottle 14 and into the spent motor oil bottle 14.

STEP 17: Thread again the oil bottle plastic cap 12 of the spent motor oil bottle 14 onto the oil bottle externally-threaded neck 72 of the spent motor oil bottle 14.

It will be understood that each of the elements described above, or two or more together, may also find a useful application in other types of constructions differing from the types described above.

While the invention has been illustrated and described as embodied in a bottle cap adaptable spout, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A bottle cap adaptable spout attachable to a plastic cap of a spent motor oil bottle that has been appropriately modified by having a centrally-disposed and circular-shaped throughbore with a diameter punched into a closed and circular-shaped top of the plastic cap of the spent motor oil bottle so as to convert the spent motor oil bottle into an oiler for dispensing oil contained therein wherein the closed and circular-shaped top of the plastic cap of the spent motor oil bottle has an outer surface and an inner surface with a gasket thereon, comprising:

a) a hollow, elongated, slender, and cylindrically-shaped spout tube having an open proximal end and an open distal end;

b) a hollow and generally conically-shaped nozzle extending coaxially outwardly from, and in fluid communication with, said open distal end of said hollow, elongated, slender, and cylindrically-shaped spout tube;

c) a hollow, externally-threaded, and cylindrically-shaped tube having an open distal end, an open proximal end entering the centrally-disposed and circular-shaped throughbore in the closed and circular-shaped top of the plastic cap of the spent motor oil bottle and into the spent motor oil bottle, and a diameter;

d) a hexagonally-shaped nut fixedly and coaxially attached to, and in fluid communication with, said open distal end of said hollow, externally-threaded, and cylindrically-shaped tube and providing a holding surface for at least one of turning said hollow, externally-threaded, and cylindrically-shaped tube and turning components relative thereto;

e) a hollow and cylindrically-shaped collar extending coaxially outwardly from, and in fluid communication with, said hexagonally-shaped nut, and coaxially and fixedly receiving said open proximal end of said hollow, elongated, slender, and cylindrically-shaped spout tube and being in fluid communication therewith;

f) a first combination hexagonally-shaped nut and washer having a hexagonally-shaped nut and a circular-shaped washer being integrally formed with, and in fluid communication with, said hexagonally-shaped nut of said first combination hexagonally-shaped nut and washer; said hexagonally-shaped nut of said first combination hexagonally-shaped nut and washer threadably engaging said hollow, externally-threaded, and cylindrically-shaped tube, with said circular-shaped washer of said first combination hexagonally-shaped nut and washer facing downwardly towards said open proximal end of said hollow, externally-threaded, and cylindrically-shaped tube;

g) a first circular-shaped washer disposed on said hollow, externally-threaded, and cylindrically-shaped tube, between, and abutting against, said circular-shaped washer of said first combination hexagonally-shaped nut and washer and the outer surface of the closed and circular-shaped top of the plastic cap of the spent motor oil bottle;

h) a second circular-shaped washer disposed on said hollow, externally-threaded, and cylindrically-shaped tube and abutting against the gasket on the inner surface of the closed and circular-shaped top of the plastic cap of the spent motor oil bottle;

i) a second combination hexagonally-shaped nut and washer having a hexagonally-shaped nut and a circular-shaped washer being integrally formed with, and in fluid communication with, said hexagonally-shaped nut of said second combination hexagonally-shaped nut and washer; said hexagonally-shaped nut of said second combination hexagonally-shaped nut and washer threadably engaging said hollow, externally-threaded, and cylindrically-shaped tube, with said circular-shaped washer of said second combination hexagonally-shaped nut and washer abutting against said second circular-shaped washer, so that when said first combination hexagonally-shaped nut and said second combination hexagonally-shaped nut are tightened said first circular-shaped washer snugly abuts against the outer surface of the closed and circular-shaped top of the plastic cap of the spent motor oil bottle and said second circular-shaped washer snugly abuts against the gasket on the inner surface of the closed and circular-shaped top of the plastic cap of the spent motor oil bottle causing the closed and circular-shaped top of the plastic cap of the spent motor oil bottle to longitudinally compress and laterally expand against said hollow, externally-threaded, and cylindrically-shaped tube and form a leak proof seal for the centrally-disposed and circular-shaped throughbore in the closed and circular-shaped top of the plastic cap of the spent motor oil bottle; and j) a hollow, elongated, slender, and cylindrically-shaped pick-up tube having an open distal end received coaxially in, and in fluid communication with, said open proximal end of said hollow, externally-threaded, and cylindrically-shaped tube, and an open proximal end extending into the spent motor oil bottle and in fluid communication with the oil contained therein, so that when the spent motor oil bottle is squeezed the oil contained therein is picked up by said open proximal end of said hollow, elongated, slender, and cylindrically-shaped pick-up tube and flows through said hollow, elongated, slender, and cylindrically-shaped pick-up tube, through said hollow, externally-threaded, and cylindrically-shaped tube, through said hollow and cylindrically-shaped collar, through said hollow, elongated, slender, and cylindrically-shaped spout tube, and through and out of said hollow and generally conically-shaped nozzle allowing the spent motor oil bottle to function as the oiler and selectively dispense the oil contained therein.

2. The spout as defined in claim 1, wherein said hollow, elongated, slender, and cylindrically-shaped spout tube is one of flexible and rigid.

3. The spout as defined in claim 1, wherein said diameter of said hollow, externally-threaded, and cylindrically-shaped tube is equivalent to the diameter of the centrally-disposed and circular-shaped throughbore in the closed and circular-shaped top of the plastic cap of the spent motor oil bottle.

4. The spout as defined in claim 1, wherein said hollow and cylindrically-shaped collar is crimped around said open proximal end of said hollow, elongated, slender, and cylindrically-shaped spout tube.

5. The spout as defined in claim 1, wherein said hollow, elongated, slender, and cylindrically-shaped pick-up tube is plastic.

6. The spout as defined in claim 1, wherein said open distal end of said hollow, elongated, slender, and cylindrically-shaped pick-up tube is maintained in said open proximal end of said hollow, externally-threaded, and cylindrically-shaped tube by a force fit.

7. The spout as defined inc claim 1, wherein said open proximal end of said hollow, elongated, slender, and cylindrically-shaped pick-up tube is slanted.

8. The spout as defined in claim 1, wherein said hollow, elongated, slender, and cylindrically-shaped pick-up tube has a variable depth in the spent motor oil bottle and a length.

9. The spout as defined in claim 8, wherein said variable depth of said hollow, elongated, slender, and cylindrically-shaped pick-up tube in the spent motor oil bottle is accomplished by trimming said length of said hollow, elongated, slender, and cylindrically-shaped pick-up tube.

10. The spout as defined claim 8, wherein said variable depth of said hollow, elongated, slender, and cylindrically-shaped pick-up tube in the spent motor oil bottle is accomplished by threading said hollow, externally-threaded, and cylindrically-shaped tube relative to at least one of said first combination hexagonally-shaped nut and washer and said second combination hexagonally-shaped nut and washer, so that a different amount of said hollow, externally-threaded, and cylindrically-shaped tube is in the spent motor oil bottle.

11. The spout as defined in claim 1; further comprising punching means for punching the centrally-disposed and circular-shaped throughbore in the closed and circular-shaped top of the plastic cap of the spent motor oil bottle and in the gasket on the inner surface of the closed and circular-shaped top of the plastic cap of the spent motor oil bottle.

12. The spout as defined in claim 11, wherein said punching means includes a hollow and cylindrically-shaped punch with a sharp end.

13. A method of utilizing a bottle cap adaptable spout to convert a spent motor oil bottle into an oiler by attaching said bottle cap adaptable spout to a plastic cap of the spent motor oil bottle that has been appropriately modified, comprising the steps of:

a) placing the plastic cap of the spent motor oil bottle on a hard work surface with a closed and circular-shaped top of the plastic cap of the spent motor oil bottle resting thereon;

b) placing a hollow and cylindrically-shaped punching tool in the plastic cap of the spent motor oil bottle with a sharp punching end of said hollow and cylindrically-shaped punching tool resting on a gasket on an inner surface of the closed and circular-shaped top of the plastic cap of the spent motor oil bottle, at and coaxial with, a longitudinal center of the plastic cap of the spent motor oil bottle;

c) hitting said cylindrically-shaped punching tool with a hammer forcing said sharp punching end of said cylindrically-shaped punching tool to pierce through the gasket on the inner surface of the closed and circular-shaped top of the plastic cap of the spent motor oil bottle and to pierce through the closed and circular-shaped top of the plastic cap of the spent motor oil bottle so as to punch out a plug and leave a centrally-disposed and circular-shaped throughbore extending therethrough that has a diameter;

d) threading a hexagonally-shaped nut of a first combination hexagonally-shaped nut and washer of said bottle cap adaptable spout onto a hollow, externally-threaded, and cylindrically-shaped tube of said bottle cap adaptable spout, with a circular-shaped washer of said first combination hexagonally-shaped nut and washer facing downwardly towards an open proximal end of said hollow, externally-threaded, and cylindrically-shaped tube;

e) placing a first circular-shaped washer of said bottle cap adaptable spout on said hollow, externally-threaded, and cylindrically-shaped tube, abutting against said circular-shaped washer of said first combination hexagonally-shaped nut and washer;

f) inserting said open proximal end of said hollow, externally-threaded, and cylindrically-shaped tube through the centrally-disposed and circular-shaped throughbore in the closed and circular-shaped top of the plastic cap of the spent motor oil bottle, towards the gasket on the inner surface of the closed and circular-shaped top of the plastic cap of the spent motor oil bottle, so that said first circular-shaped washer is between, and abuts against, said circular-shaped washer of said first combination hexagonally-shaped nut and washer and an outer surface of the closed and circular-shaped top of the plastic cap of the spent motor oil bottle;

g) placing a second circular-shaped washer of said bottle cap adaptable spout on said hollow, externally-threaded, and cylindrically-shaped tube, abutting against the gasket on the inner surface of the closed and circular-shaped top of the plastic cap of the spent motor oil bottle;

h) threading a hexagonally-shaped nut of a second combination hexagonally-shaped nut and washer of said bottle cap adaptable spout onto said hollow, externally-threaded, and cylindrically-shaped tube, with a circular-shaped washer of said second combination hexagonally-shaped nut and washer abutting against said second circular-shaped washer, so that said second circular-shaped washer is between, and abuts against, the gasket on the inner surface of the closed and circular-shaped top of the plastic cap of the spent motor oil bottle and said circular-shaped washer of said second combination hexagonally-shaped nut and washer;

i) tightening said hexagonally-shaped nut of said first combination hexagonally-shaped nut and washer and said hexagonally-shaped nut of said second combination hexagonally-shaped nut and washer so as to cause the first circular-shaped washer and the second circular-shaped washer to longitudinally compress and laterally expand the closed and circular-shaped top of the plastic cap of the spent motor oil bottle against said hollow, externally-threaded, and cylindrically-shaped tube so as to form a leak proof seal for the centrally-disposed and circular-shaped throughbore in the closed and circular-shaped top of the plastic cap of the spent motor oil bottle;

j) inserting an open distal end of a hollow, elongated, slender, and cylindrically-shaped pick-up tube of said bottle cap adaptable spout snugly into said open proximal end of said hollow, externally-threaded, and cylindrically-shaped tube;

k) inserting an open proximal end of said hollow, elongated, slender, and cylindrically-shaped pick-up tube through an externally-threaded neck of the spent motor oil bottle and into the spent motor oil bottle; and l) threading the plastic cap of the spent motor oil bottle onto the externally-threaded neck of the spent motor oil bottle.

14. The method as defined in claim 13; further comprising the step of determining if said hollow, elongated, slender, and cylindrically-shaped pick-up tube is of proper depth in the spent motor oil bottle.

15. The method as defined in claim 14; further comprising the step of removing the plastic cap of the spent motor oil bottle from the externally-threaded neck of the spent motor oil bottle if said hollow, elongated, slender, and cylindrically-shaped pick-up tube is not of the proper depth in the spent motor oil bottle.

16. The method as defined in claim 15; further comprising the step of trimming said hollow, elongated, slender, and cylindrically-shaped pick-up tube to a proper length.

17. The method as defined in claim 15; further comprising the steps of:

a) loosening said hexagonally-shaped nut of said first combination hexagonally-shaped nut and washer and said hexagonally-shaped nut of said second combination hexagonally-shaped nut and washer;

b) threading said hollow, externally-threaded, and cylindrically-shaped tube, by use of a hexagonally-shaped nut fixedly attached thereto, relative to at least one of said hexagonally-shaped nut of said first combination hexagonally-shaped nut and washer and said hexagonally-shaped nut of said second combination hexagonally-shaped nut and washer until a desired position of said hollow, externally-threaded, and cylindrically-shaped tube relative to the plastic cap of the spent motor oil bottle is achieved, so that a different amount of said hollow, externally-threaded, and cylindrically-shaped tube is in the spent motor oil bottle when the plastic cap of said spent motor oil bottle is replaced;

c) tightening said hexagonally-shaped nut of said first combination hexagonally-shaped nut and washer and said hexagonally-shaped nut of said second combination hexagonally-shaped nut and washer;

d) inserting again said open proximal end of said hollow, elongated, slender, and cylindrically-shaped pick-up tube through the externally-threaded neck of the spent motor oil bottle and into the spent motor oil bottle; and e) threading again the oil bottle plastic cap of the spent motor oil bottle onto the externally-threaded neck of the spent motor oil bottle.

18. A method for converting a spent motor oil bottle to an oiler for dispensing oil contained therein, comprising the step of adapting to a plastic cap of the spent motor oil bottle, that has been appropriately modified by punching a centrally-disposed and circular-shaped throughbore in a closed and circular-shaped top of the plastic cap of the spent oil bottle wherein the closed and circular-shaped top of the plastic cap of the spent oil bottle has an outer surface and an inner surface with a gasket thereon, a bottle cap adaptable spout which comprises:

a) a hollow, elongated, slender, and cylindrically-shaped spout tube having an open proximal end and an open distal end;

b) a hollow and generally conically-shaped nozzle extending coaxially outwardly from, and in fluid communication with, said open distal end of said hollow, elongated, slender, and cylindrically-shaped spout tube;

c) a hollow, externally-threaded, and cylindrically-shaped tube having an open distal end, an open proximal end entering the centrally-disposed and circular-shaped throughbore in the closed and circular-shaped top of the plastic cap of the spent motor oil bottle and into the spent motor oil bottle, and a diameter;

d) a hexagonally-shaped nut fixedly and coaxially attached to, and in fluid communication with, said open distal end of said hollow, externally-threaded, and cylindrically-shaped tube and providing a holding surface for at least one of turning said hollow, externally-threaded, and cylindrically-shaped tube and turning components relative thereto;

e) a hollow and cylindrically-shaped collar extending coaxially outwardly from, and in fluid communication with, said hexagonally-shaped nut, and coaxially and fixedly receiving said open proximal end of said hollow, elongated, slender, and cylindrically-shaped spout tube and being in fluid communication therewith;

f) a first combination hexagonally-shaped nut and washer having a hexagonally-shaped nut and a circular-shaped washer being integrally formed with, and in fluid communication with, said hexagonally-shaped nut of said first combination hexagonally-shaped nut and washer; said hexagonally-shaped nut of said first combination hexagonally-shaped nut and washer threadably engaging said hollow, externally-threaded, and cylindrically-shaped tube, with said circular-shaped washer of said first combination hexagonally-shaped nut and washer facing downwardly towards said open proximal end of said hollow, externally-threaded, and cylindrically-shaped tube;

g) a first circular-shaped washer disposed on said hollow, externally-threaded, and cylindrically-shaped tube, between, and abutting against, said circular-shaped washer of said first combination hexagonally-shaped nut and washer and the outer surface of the closed and circular-shaped top of the plastic cap of the spent motor oil bottle;

h) a second circular-shaped washer disposed on said hollow, externally-threaded, and cylindrically-shaped tube, abutting against the gasket on the inner surface of the closed and circular-shaped top of the plastic cap of the spent motor oil bottle;

i) a second combination hexagonally-shaped nut and washer having a hexagonally-shaped nut and a circular-shaped washer being integrally formed with, and in fluid communication with, said hexagonally-shaped nut of said second combination hexagonally-shaped nut and washer; said hexagonally-shaped nut of said second combination hexagonally-shaped nut and washer threadably engaging said hollow, externally-threaded, and cylindrically-shaped tube, with said circular-shaped washer of said second combination hexagonally-shaped nut and washer abutting against said second circular-shaped washer, so that when said first combination hexagonally-shaped nut and said second combination hexagonally-shaped nut are tightened said first circular-shaped washer snugly abuts against the outer surface of the closed and circular-shaped top of the plastic cap of the spent motor oil bottle and said second circular-shaped washer snugly abuts against the gasket on the inner surface of the closed and circular-shaped top of the plastic cap of the spent motor oil bottle causing the closed and circular-shaped top of the plastic cap of the spent motor oil bottle to longitudinally compress and laterally expand against said hollow, externally-threaded, and cylindrically-shaped tube and form a leak proof seal for the centrally-disposed and circular-shaped throughbore in the closed and circular-shaped top of the plastic cap of the spent motor oil bottle; and j) a hollow, elongated, slender, and cylindrically-shaped pick-up tube having an open distal end received coaxially in, and in fluid communication with, said open proximal end of said hollow, externally-threaded, and cylindrically-shaped tube, and an open proximal end extending into the spent motor oil bottle and in fluid communication with oil contained therein, so that when the spent motor oil bottle is squeezed the oil contained therein is picked up by said open proximal end of said hollow, elongated, slender, and cylindrically-shaped pick-up tube and flows through said hollow, elongated, slender, and cylindrically-shaped pick-up tube, through said hollow, externally-threaded, and cylindrically-shaped tube, through said hollow and cylindrically-shaped collar, through said hollow, elongated, slender, and cylindrically-shaped spout tube, and through and out of said hollow and generally conically-shaped nozzle allowing the spent motor oil bottle to function as the oiler and selectively dispense the oil contained therein.

* * * * *